US005871006A

United States Patent [19]

Carr et al.

[11] Patent Number: 5,871,006

[45] Date of Patent: Feb. 16, 1999

[54] HOT WATER HEATING SYSTEM

[75] Inventors: R. Murray Carr, Tulsa; Bill O. Rollings, Glenpool; David E. Auten, Tulsa, all of Okla.

[73] Assignee: WEBCO Industries, Inc., Sand Springs, Okla.

[21] Appl. No.: 763,162

[22] Filed: Dec. 10, 1996

[51] Int. Cl.[6] ..... F24H 1/10

[52] U.S. Cl. ..... 126/355; 126/351; 126/359; 126/360 R; 122/412

[58] Field of Search ..... 126/359, 360 R, 126/355, 360 A, 351; 122/28, 20 A, 412, 417, 31 R; 110/215

[56] References Cited

U.S. PATENT DOCUMENTS

| | | | |
|---|---|---|---|
| 4,530,347 | 7/1985 | Baker et al. | 126/360 R |
| 4,574,775 | 3/1986 | Lutzen et al. | 126/359 |
| 4,773,390 | 9/1988 | Watts | 126/355 |

*Primary Examiner*—Larry Jones
*Attorney, Agent, or Firm*—Head, Johnson & Kachigian

[57] ABSTRACT

A hot water heating system having a water tower with a cold water inlet at the upper end and a hot water outlet at the lower end has a large diameter combustion inlet opening in the sidewall. A combustion chamber is secured to the water tower at the combustion inlet so that products of combustion of fuel consumed in the combustion chamber pass into the water tower and are exhausted through a vent. An outer shell surrounds the combustion chamber providing an annular chamber having a water inlet. A port communicates the upper interior of the annular chamber with the interior of the water tower. Water is circulated from a hot water storage through the annular chamber and through the port into the interior of the water tower. The recirculated water thus accomplishing the dual functions of cooling the combustion chamber and salvaging heat extracted from the combustion chamber to augment the heat of the water in the storage tank. In a preferred arrangement, the interior of the combustion chamber is provided with fins to augment the transfer of heat from the combustion chamber to water in the annular area.

16 Claims, 4 Drawing Sheets

HOT WATER HEATING SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

I. Field of the Invention

This invention relates to a hot water heating system which sometimes is referred to as a "demand hot water system" and is of the type used primarily for industrial and commercial applications for producing high volumes of hot water at a very high efficiency rate.

II. Background of the Invention

In hot water heating system of this invention, fuel is combusted to produce a flame and products of combustion are contacted directly with water to be heated to thereby achieve maximum transfer of the heat of combustion to the water resulting in extremely high efficiency. An advantage of the hot water heating system of this invention is that by directly contacting the water to be heated with the products of combustion, a higher degree of sterilization of the water is obtained, that is, a higher percentage of any entrained bacteria is killed compared to other hot water heating systems wherein a membrane, whether metal or some other material, separates the source of heat from the water itself.

A good reference to form a background of the present invention is U.S. Pat. No. 4,773,390 issued Sep. 22, 1987 and entitled "Demand Hot Water System". This patent describes a high efficiency hot water system in which fuel is combusted with the products of combustion contacting water to be heated within a water tower. The present invention includes significant improvements, refinements and innovations over the basic concept of the demand hot water system described and illustrated in this patent.

For additional background information relating to hot water heating systems of the type commonly employed in industrial and commercial applications, reference may be had to the following previously issued United States patents:

| U.S. Pat. No. | INVENTOR | TITLE |
|---|---|---|
| 1820755 | McMullen | Method of Preparing Liquid Fuel For Burning |
| 2218281 | De Ridder et al | Method For Cooling Flue Gas |
| 2975594 | Eastman | Generation of Power From Ash-Forming Hydrocarbons |
| 3183864 | Stengel | Method and System For Operating A Furnace |
| 3741712 | Delatronchette | Supply System For A Light Hydrocarbon-Water Emulsion Burner |
| 3749318 | Cottell | Combustion Method and Apparatus Burning An Intimate Emulsion Of Fuel and Water |
| 3797992 | Straitz, III | Crude Oil Burner |
| 3814567 | Zink et al | Smokeless Flare Using Liquid Water Particles |
| 3860384 | Vulliet et al | Method To Control Nox Formation In Fossil-Fueled Boiler Furnaces |
| 4089633 | Barghout et al | Combustion Vapor Generator |
| 4089639 | Reed et al | Fuel-Water Vapor Premix For Low Nox Burning |
| 4368035 | McCartny et al | Method and Apparatus For Heating Aggregate |
| 4394118 | Martin | Method and Arrangement For Reducing Nox Emissions From Furnaces |
| 4406610 | Duijvestijn | Process and Burner For The Partial Combustion of A Liquid or Gaseous Fuel |
| 4538981 | Ventrurini | Combustion Catalyzing System For Commercial Grade Fuels |
| 4634370 | Chesters | Flare |
| 4773390 | Watts | Demand Hot Water System |
| 5249957 | Hirata | Emulsion Producing Apparatus and Its Combustion System |

In addition to these previously issued patents, the references cited against them that are not specifically enumerated hereinabove also form good background material relating to the subject of this invention.

BRIEF SUMMARY OF THE INVENTION

A hot water heating system is provided that includes an upright water tower having a sidewall in which is formed a relatively large combustion inlet opening. The inlet opening is spaced intermediate the top and bottom end of the water tower. In addition to the larger inlet opening, a smaller cold water inlet is provided adjacent the top and a hot water outlet is provided adjacent the lower end of the water tower. In addition, in the preferred embodiment, an intermediate water inlet is provided below the cold water inlet and above the combustion inlet opening.

A combustion chamber is secured to the water tower at the combustion inlet opening. The combustion chamber typically extends at an approximate right angle to the water tower, that is, generally horizontally. The combustion chamber has a burner secured to it having a fuel inlet. The burner functions to inject fuel into the combustion chamber.

A draft producing fan is employed to cause air to flow through the combustion chamber. The air producing fan may be in the form of an induced draft arrangement or, in the illustrated embodiment, is a forced draft fan by which air is injected from the burner into the combustion chamber.

The combustion of fuel and forced air within the combustion chamber produces hot gases that pass from the combustion chamber directly into the water tower. The hot combustion gases move upwardly in the water tower to contact the downwardly descending water so that the heat of the hot gases of combustion is transferred directly to the water thereby achieving very efficient heat transfer.

In a preferred embodiment of the invention, a hot water storage tank is connected to the water tower hot water outlet to provide a reservoir of hot water produced by the system. To maintain the temperature of the water in the reservoir, a recirculation system is employed. By means of a recirculation pump, water is drawn from the hot water storage tank and recycled back into the water tower at an intermediate water inlet opening, the water passing downwardly through the water tower and back into the storage tank.

A common problem with high intensity hot water systems is that the combustion chamber usually does not have long useful life expectancy. Since combustion chambers are subjected to the intense heat produced by the burning of fuel, they are exposed to a high rate of oxidation, especially if the temperature of the combustion chamber is permitted to exceed maximum level. To provide for longer combustion chamber life and to assist in the extraction of heat from the combustion process, the combustion chamber is, in a preferred embodiment, provided with an outer shell forming an annular chamber. A water inlet is provided to this water chamber and is connected to the recirculation system to receive the inlet flow of water recirculated from the hot water storage tank. A passageway is provided between the interior of the annular chamber and the interior of the water tower. This passageway can be achieved in a variety of ways. In one embodiment, a weir-shaped passageway is formed where the annular chamber contacts the water tower sidewall so that water flows out of the annular chamber over the weir and directly into the interior of the water tower. The recirculated water passes downwardly, contacting the hot gases resulting from the combustion of fuel in the combustion chamber and into the lower end of the water tower and out into the hot water storage tank. By this system, hot water is circulated from the hot water storage tank through the annular chamber to cool and maintain the annular chamber at a temperature that substantially increases the life expectancy of the combustion chamber while, at the same time, heat is extracted from the combustion chamber to be absorbed by the recirculating water.

The combustion chamber preferably includes internal fins which may be planar in shape and spaced radially around the interior of the chamber or that may be in the form of a spiral. Irrespective of the form of the fins within the interior of the combustion chamber, their function is to absorb increased heat from the products of combustion, the heat being added to the water that is circulated through the annular chamber.

One problem with combustion chambers formed interiorly of an outer shell that provides an annular chamber is that the combustion chamber is subjected to substantially higher heat intensities than the outer shell, resulting in different rates of thermal expansion. To solve this problem which has existed with other types of high energy efficient hot water systems, the combustion chamber of this invention is free at the inner end, that is, the combustion chamber is sealed to the outer shell at the outer end adjacent the burner, but the inner end can move relative to the outer shell so that changes in thermal expansion do not impose any stress on either the combustion chamber or the outer shell.

In a preferred arrangement, the water chamber is filled with packing material. Cold water from the inlet as well as recirculated water trickles downwardly through the packing countercurrent to the upward flow of the gases of combustion to efficiently commingle for highly efficient heat transfer.

A better understanding of the invention will be obtained from the following description of the preferred embodiments and claims, taken in conjunction with the attached drawings.

DETAILED DESCRIPTION OF THE PREFERRED EMBODIMENTS

Figure 3:
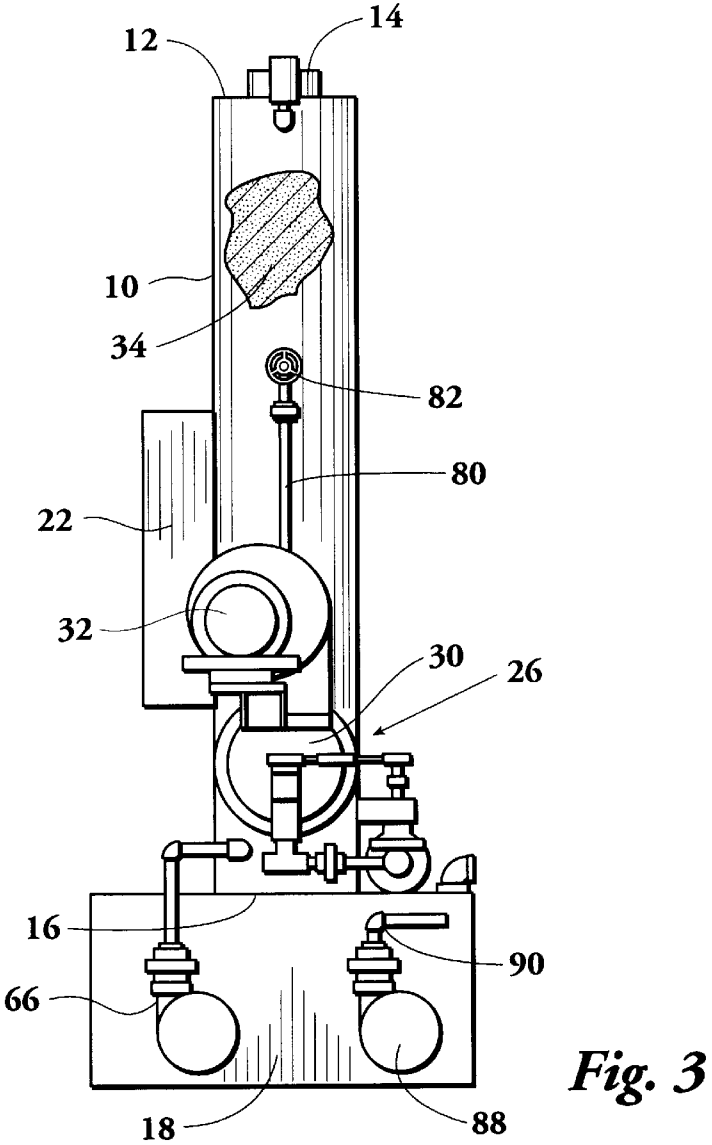
FIG. 3 is a side view of the hot water heating system of FIG. 2 showing the basic elements making up the hot water heating system.
Figure 1:
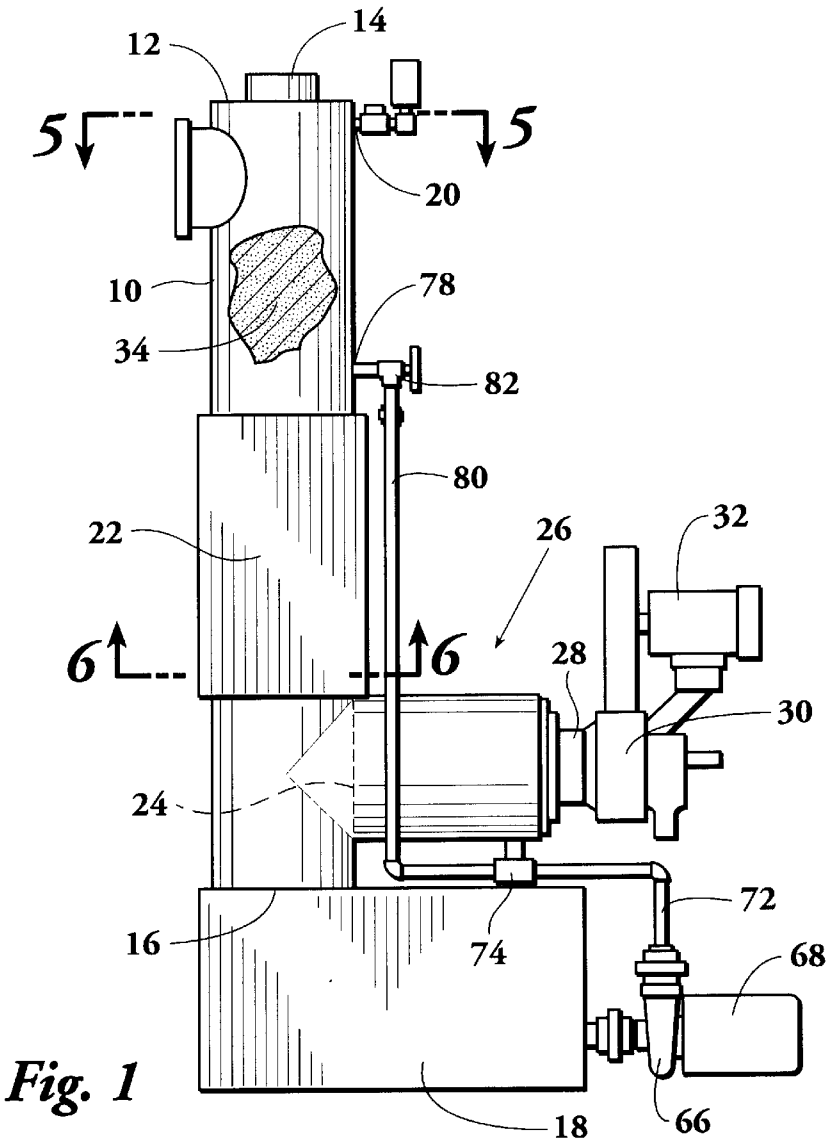
FIG. 1 is an elevational side view of a hot water heating system of this invention showing the basic components of the system and illustrating a typical example of one physical embodiment of the elements making up the system for practicing the invention.

Referring to the drawings and first to FIGS. 1 and 3, a hot water heating system that employs the principles of this invention is illustrated. It is understood that the actual appearance of a system that practices the invention may have an appearance that is completely dissimilar to that shown in FIGS. 1 and 3. The system includes a vertical water tower 10 that is illustrated as being cylindrical but can be rectangular or of any other cross-sectional configuration. Tower 10 has a top end 12 in which is formed an exhaust gas vent 14. Tower 10 further has a bottom end 16 that, in the illustrated arrangement, rests on a hot water storage tank 18. This is by way of example only as the hot water storage tank 18 can be a separate vessel positioned adjacent to water tower 10. The illustrated arrangement is compact and has the advantage that water flows directly downwardly from water tower 10 into hot water storage tank 18.

An inlet 20 is formed adjacent water tower top end 12 through which cold water is introduced into the interior of the water tower.

Secured to the water tower is a control panel 22 that contains a control system. This is also by example only as the control panel can be remotely located from the water tower, or otherwise supported relative to the system.

Formed in the wall of water tower 10 is a combustion inlet opening 24, illustrated by dotted line 24 in FIG. 1. Extending from water tower 10 at combustion inlet opening 24 is a combustion chamber 26 that will be described in detail subsequently. Affixed to the outer end of combustion chamber 26 is a burner 28 and a blower 30 driven by motor 32. Blower 30 is an example of one means of providing a draft through the burner and combustion chamber to augment the burning of fuel within the combustion chamber in a way to be described subsequently. While blower 30, driven by motor 32, is illustrated and is a preferred way of providing the draft of air necessary through the combustion chamber, it can be easily understood that an induced draft system can be employed which may be secured adjacent the exhaust vent outlet 14.

Figure 6:
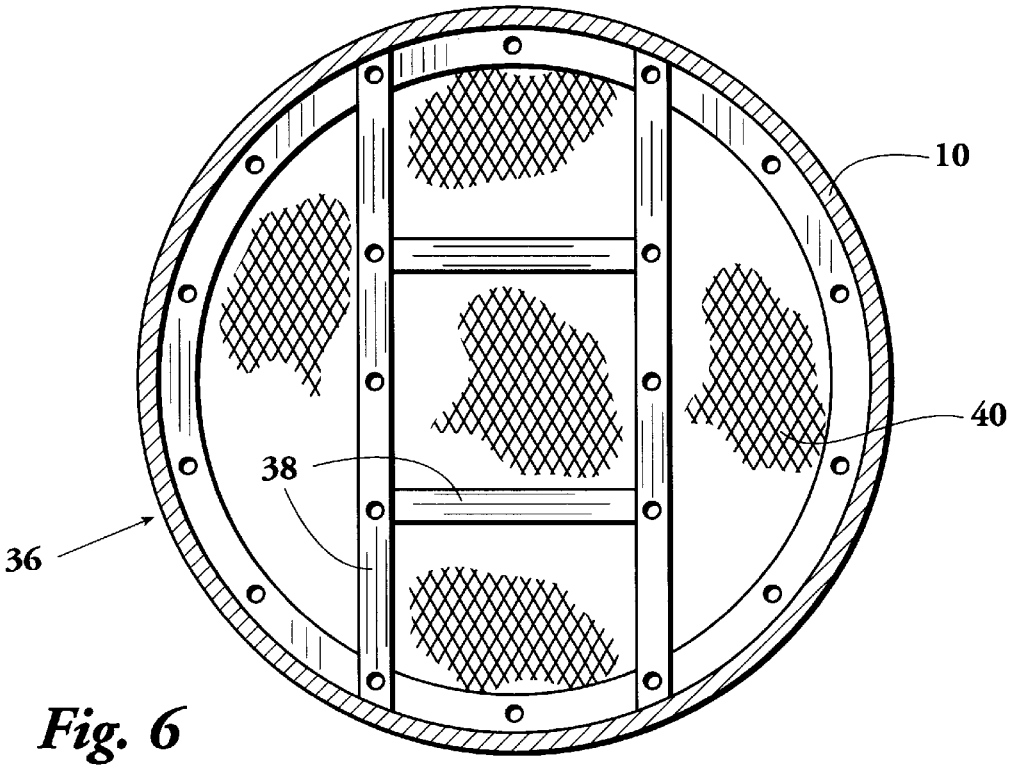
FIG. 6 is a horizontal cross-sectional view of the water tower taken along the line 6—6 of FIG. 1 and showing a foranimous shelf positioned within the water tower that supports packing material that disperses downward movement of water against the upward movement of the products of combustion to more effectively commingle the two.

Water tower 10 has an interior area 33, a major part of the upper portion of which is preferably filled with packing material 34. The packing is supported on a shelf 36 as seen in FIG. 6, the shelf being made of structural members 38 that supports expanded metal 40 or other foranimous material which retains the packing within the water tower. The packing extends from adjacent the top of the water tower to just above combustion inlet opening 24.

Figure 5:
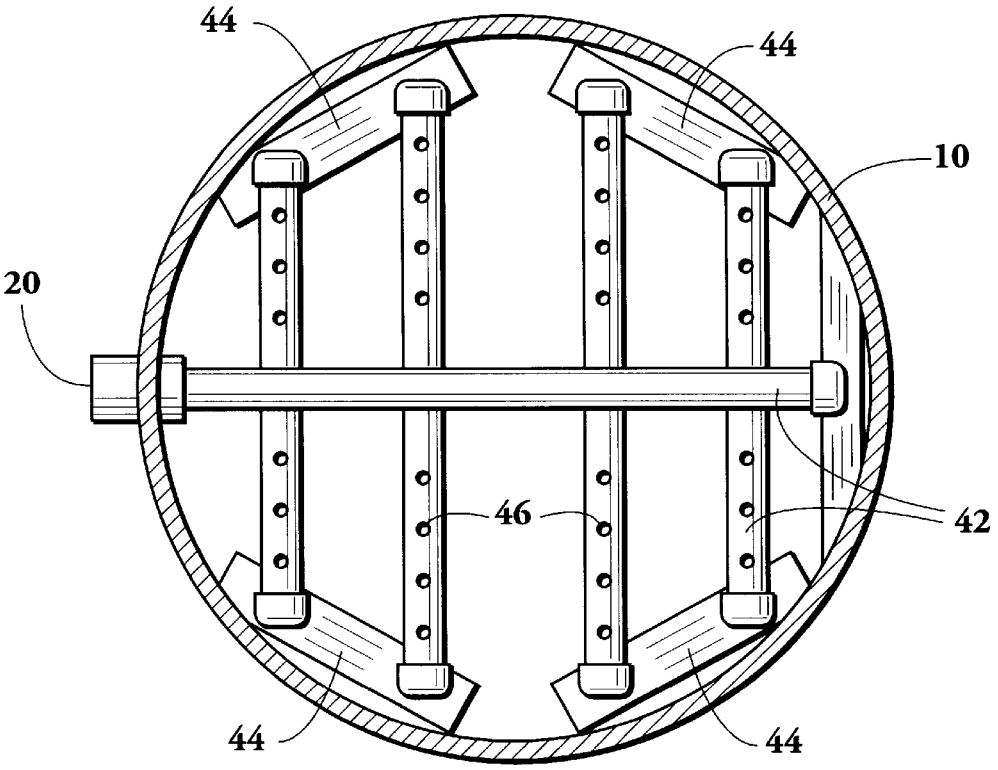
FIG. 5 is a cross-sectional view of the hot water heating system as taken along the line 5—5 of FIG. 1 showing the interior of the top portion of the water tower and showing piping forming one means of providing a water distribution system within the water tower by which cold water is distributed to pass downwardly within the water tower.

Cold water entering water tower 10 through cold water inlet 20 should be dispersed to pass evenly downwardly through the packing. Therefore, a system such as shown in FIG. 5 may employed. Piping 42 is connected to cold water inlet 20, the piping being supported by structures 44 within water tower 10, the piping having holes 46 through which water passes so that it is thoroughly dispersed before it begins its journey downwardly through the interior of the water tower. Alternatively, the water could be passed through spray nozzles.

Figure 2:
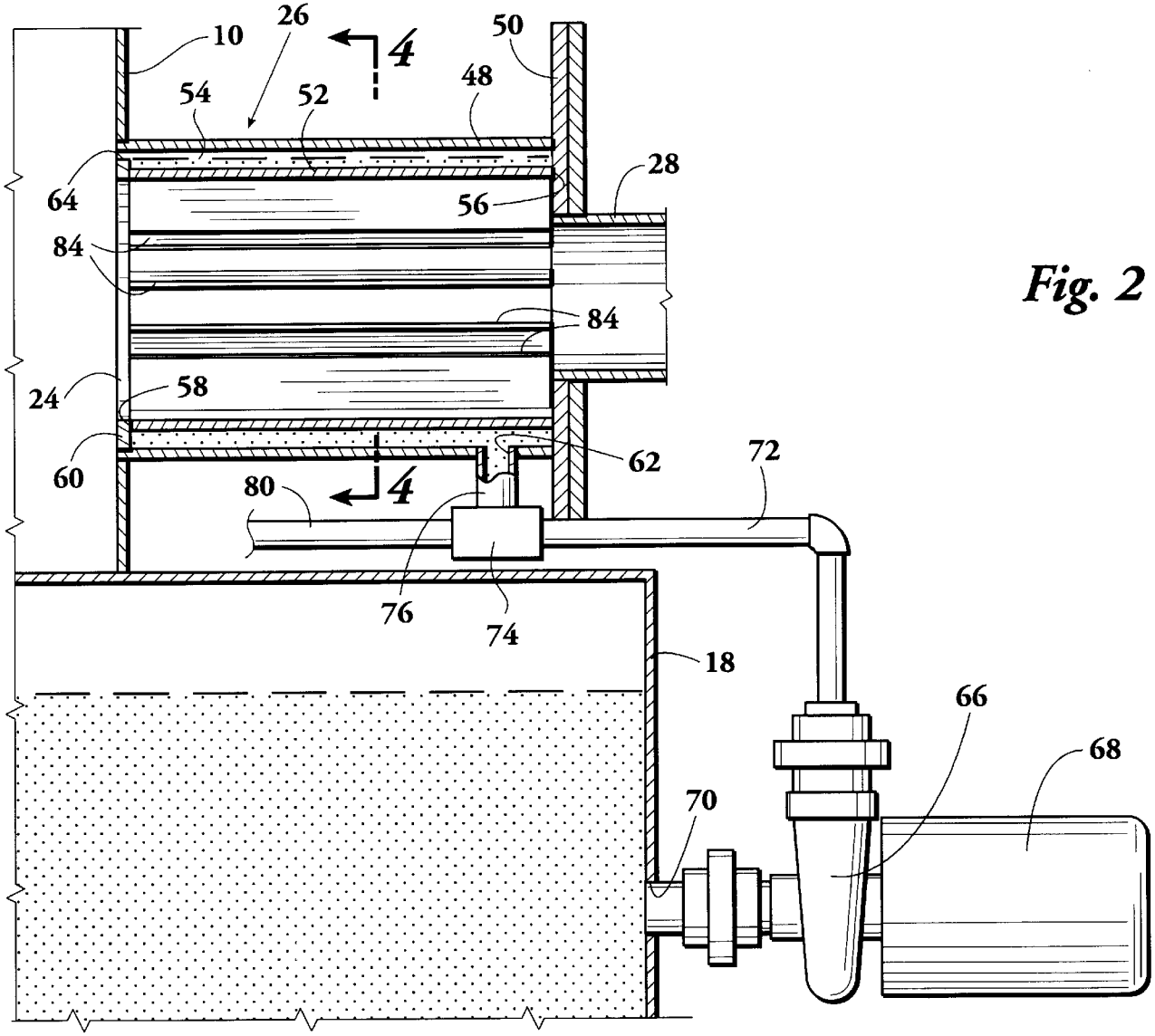
FIG. 2 is an enlarged partial view of the lower portion of the hot water heating system of FIG. 1 showing primarily the hot water storage tank and a cross-sectional view of the combustion chamber and the annular area surrounding the combustion chamber. This view also shows the passageway port communicating the interior of the annular chamber with the interior of the water tower and shows a portion of the burner connected to the combustion chamber.

An important aspect of the invention is the improved combustion chamber 26 which is best illustrated in the cross-sectional view of FIG. 2. As previously stated, water tower 10 has a combustion inlet opening 24. A combustion chamber outer shell 48 is welded or otherwise secured to the water tower in leak proof arrangement to encompass opening 24. The outer shell extends generally horizontally from the vertical water tower and has an outer flange 50 to which is secured the inner portion of burner 28.

Positioned within outer shell 48 is a concentric inner shell 52 that is spaced from the outer shell 48 leaving an annular chamber 54. The outer end 56 of inner shell 52 is secured to flange 50. The inner end 58 of inner shell 52 receives a circumferential flange 60 having an outer periphery that closely matches but is not welded or otherwise attached to the interior of outer shell 48. That is, flange 60 is secured to inner shell 52 but is not secured to outer shell 48 which means that flange 60 may slidably move relative to outer shell 48.

Figure 4:
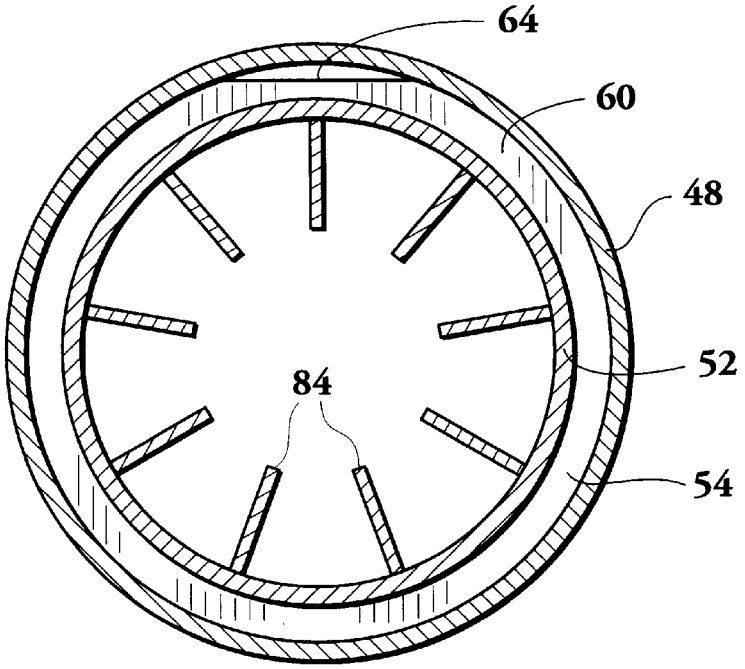
FIG. 4 is a cross-sectional view of the combustion chamber as taken along the line 4—4 of FIG. 2 and shows the combustion chamber inner wall. An annular chamber surrounds the combustion chamber. A weir forms the passageway port by which water flows from the annular chamber into the water tower.

Outer shell 48 has a water inlet 62 by which water is introduced into annular area 54 in a manner to be described subsequentially. Water inlet 62 is preferably adjacent flange 50. A passageway is provided for the passage of water out of annular chamber 54 into the interior of water tower 10. While this passageway may be of various geometrical shapes, this passageway may be in the form of a weir 64 as seen in FIGS. 2 and 4. This passageway port may also be formed by making flange 60 a smaller diameter than required to fit outer shell 48, or by holes drilled in flange 60. Thus, water flowing into annular area 54 through inlet opening 62 fills annular area and flows out through weir 64 or some other type opening into the interior of water tower 10. This flow of water serves two different yet very important purposes. First, the flow of water in the annular area 54 serves to cool inner shell 52. Inner shell 52 is subject to the heat of combustion of fuel and air from burner 28. By cooling inner shell 52, deterioration from excessive heat is reduced. Second, water flowing within annular chamber 54 absorbs heat from inner shell 52 thereby heating the water prior to the passage of the water into the water tower 10, thus conserving heat produced by the fuel consumed within the combustion chamber.

It can be seen that since flange 60 is not welded or otherwise physically secured to outer chamber 48 that, in addition to weir 64, some leakage of water could occur around the circumference of the flange. Such leakage is immaterial since the intent is to pass water from annular chamber 54 into the interior of water tower 10. Further, and of important significance, differential expansion that may occur between the inner and outer shells does not produce any stress between the inner and outer shells. This arrangement eliminates one of the major problems associated with water heaters, that is, it eliminates the problem of internal stresses that develop when portions of a heater that are in contact with hot combustion gases expand and contract at rates different than other portions of the system that are not in direct contact with these hot gases.

The hot water system uniquely employs recirculation of hot water from storage tank 18. Pump 66, driven by motor 68, pumps water from outlet opening 70 in hot water storage tank 18 by way of piping 72 to a divider 74 and then by piping 76 to inlet opening 62. Thus, water is recirculated from hot water storage tank 18 through the annular chamber 54 surrounding combustion chamber 26 and back into the interior of water tower 10 where the water passes downwardly into storage tank 18, thus completing a route that accomplishes the dual purposes above mentioned.

As illustrated in FIGS. 1 and 3, an intermediate water inlet 78 is formed in water tower 10 spaced intermediate cold water opening 20 and combustion chamber 26. Piping 80 conducts water from divider 74 to intermediate opening 78 so this recirculated water passes downwardly through packing 34 within the interior water tower 10 to flow back into storage tank 18. By means of valve 82 the ratio of water flowing through the annular chamber 54 compared to that which flows into intermediate opening 78 can be adjusted. In addition, while not shown, control valves (not shown) may be employed to vary the ratio and the quantity of water being recirculated.

A water distribution system, such as illustrated in FIG. 5, is preferably employed to receive the flow of water through intermediate opening 78.

Figure 7:
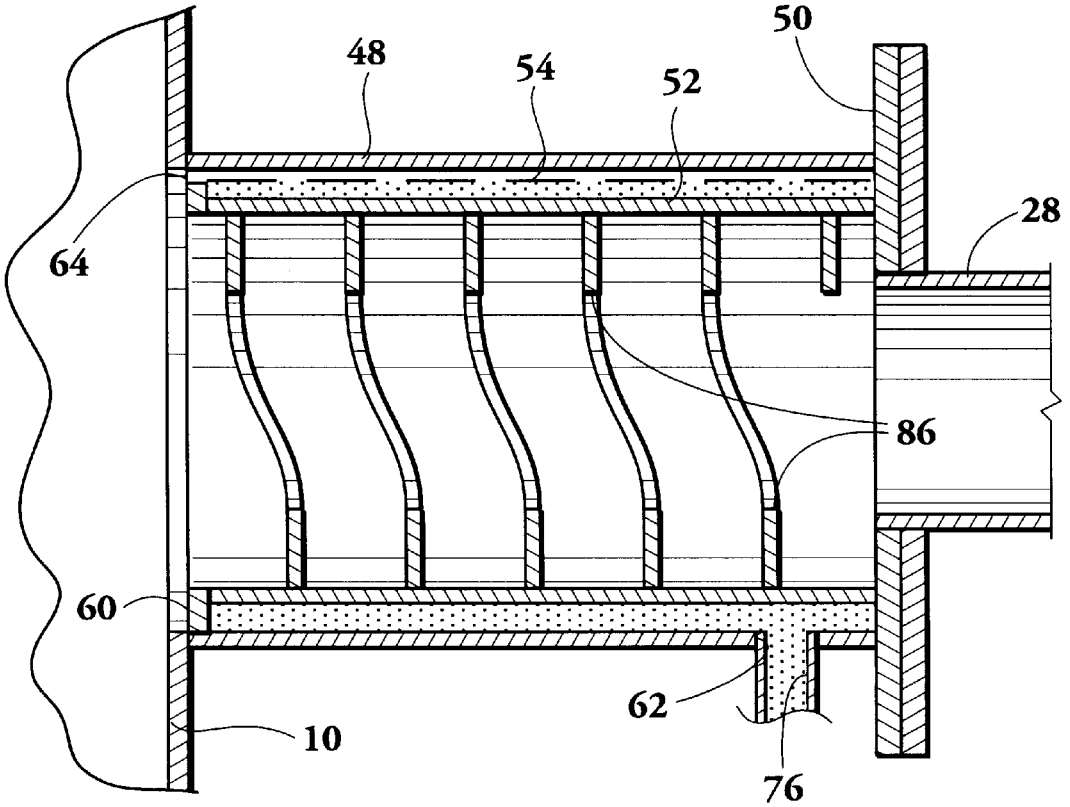
FIG. 7 is an elevational cross-sectional view of the combustion chamber as employed in the hot water heating system of FIGS. 1 and 3, and showing an alternate arrangement wherein the fin is in the shape of a spiral, the fin serving to increase heat transfer from the products of combustion to the water in the annular chamber and for causing a more intimate mixture of air with fuel in the combustion chamber.

To augment the collection of heat from the products of combustion within the combustion chamber, fins are preferably secured to the interior of inner shell 52. FIGS. 2 and 4 show the arrangement wherein straight, paralleled, radially extending fins 84 are employed. Fins 84 are contacted by the products of combustion entering the combustion chamber from burner 28 to convey an increased flow of heat to inner shell 52 and thereby to water within annular area 54 to achieve a greater efficiency of heat transfer. The fins can be of various configurations. As shown in FIGS. 2 and 4, the fins are illustrated as being straight and in radial, spaced apart planes. FIG. 7 shows an elevational cross-sectional view of combustion chamber 26 having a spiral fin 86 secured to inner shell 52. The spiral fin has the advantages of causing the flame to spiral as it passes through the combustion chamber to help insure a thorough mixture of fuel and induced air while, at the same time, efficiently conveying heat to inner shell 52 and thereby to water circulated through annular area 54. The two fin arrangements illustrated are indicative of the fact that fins can be arranged in other ways to practice the principles of the invention.

Hot water produced by the system flows out of an outlet opening (not seen) in hot water storage tank 18 and by way of a hot water supply pump 88 as seen in FIG. 3, through a hot water outlet pipe 90 for distribution.

Mechanisms, circuits and software may be contained in control panel 22 to turn on and off recirculating pump 66, hot water supply pump 88, a control valve (not seen) to regulate the flow of fuel to burner 28, and air blower 30. Methods and apparatus for control of these components of the system are well known to those skilled in the art and therefore are not illustrated or described.

The system described thus provides an improved and more efficient means of heating water using either liquid or gas fuel in an arrangement wherein maximum efficiency of use of the fuel is achieved and in a way that reduces thermal stress on components of the system.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A hot water heating system comprising:

a water tower having a sidewall, having an upper and a lower end, having an exhaust vent adjacent the upper end, having a water outlet adjacent the lower end, having a combustion inlet opening in the sidewall spaced above the lower end and having a cold water inlet adjacent the top end;

a combustion chamber supported with respect to said water tower and in communication with said combustion inlet opening;

a burner secured to said combustion chamber and having a fuel inlet;

draft producing means for causing air flow through said combustion chamber whereby fuel is burned in said combustion chamber, products of combustion flowing from said combustion chamber into said water tower and out said exhaust vent;

an outer shell having an inner end attached to said water tower sidewall and surrounding at least a portion of said combustion chamber, an interior of the outer shell and an exterior of said combustion chamber forming an annular chamber having a water inlet;

a port communicating said annular chamber with the interior of said water tower;

means to pass water to said water tower cold water inlet to provide a first inlet stream; and means to pass water to said annular chamber inlet to provide a second inlet stream, the streams being commingled and heated in said water tower.

2. A hot water system according to claim 1 including:

a hot water storage connected to said water tower water outlet including means to recirculate water from the hot water storage to said annular chamber inlet to provide said second inlet stream.

3. A hot water system according to claim 2 wherein said water tower includes an intermediate water inlet and including means to recirculate water from said hot water storage tank to the intermediate water inlet to provide a third water inlet stream that is commingled and heated with said first and second inlet streams in said water tower.

4. A hot water system according to claim 3 wherein said means to recirculate water from said hot water storage through said annular chamber and to recirculate water from said hot water storage to said intermediate water inlet includes a single recirculating pump.

5. A hot water system according to claim 1 wherein said draft producing means for producing air flow through said combustion chamber includes an air blower means secured to said combustion chamber providing compressed air to said burner.

6. A hot water system according to claim 1 including:

a water distribution means positioned within said water tower adjacent said upper end and connected to said cold water inlet.

7. A hot water system according to claim 6 including:

a foranimous shelf positioned within said water tower above said combustion inlet opening; and packing positioned within said water tower on said shelf and extending upwardly to a height below said water distribution means, the packing permitting water to flow downwardly therethrough and products of combustion to flow simultaneously upwardly therethrough.

8. A hot water heating system according to claim 1 wherein said port communicating said annular chamber with the interior of said water tower is in the form of a weir in an upper portion of said annular chamber at said water tower sidewall.

9. A hot water heating system according to claim 1 wherein said combustion chamber has a circumferential wall having an interior surface and including at least one fin secured to said interior surface by which increased heat is transferred to said annular chamber.

10. A hot water heating system according to claim 9 including a plurality of spaced apart fins in generally paralleled configuration secured to said interior surface of said combustion chamber.

11. A hot water heating system according to claim 9 wherein said at least one fin secured to said interior surface is formed in a spiral.

12. A hot water heating system according to claim 1 wherein said combustion chamber has an inner end adjacent said water tower sidewall and an outer end, wherein said combustion chamber outer end is fixed to said outer shell and wherein said inner end is free floating with respect to said water tower sidewall and said outer shell.

13. A hot water heating system comprising:

a water tower having a sidewall defining an interior area, having an upper and a lower end, having an exhaust vent adjacent the upper end, having a water outlet adjacent the lower end, having a combustion inlet opening in the sidewall spaced above the lower end and having a cold water inlet adjacent the top end and having a recirculation water inlet elevationally intermediate said cold water inlet and said combustion inlet opening, said cold and recirculation water inlets communicating directly with said tower interior area;

a combustion chamber supported with respect to said water tower and in communication with said combustion inlet opening;

a burner secured to said combustion chamber and having a fuel inlet;

draft producing means for causing air flow through said combustion chamber whereby fuel is burned in said combustion chamber, products of combustion flowing from said combustion chamber into said water tower and out said exhaust vent;

a hot water storage connected to said water tower water outlet;

means to pass water to said water tower cold water inlet to provide a first inlet stream; and means to recirculate water from said hot water storage to said recirculation water inlet to provide a second inlet stream, the first and second inlet streams being heated in said water tower by contact with said products of combustion.

14. A hot water system according to claim 13 wherein said draft producing means for producing air flow through said combustion chamber includes an air blower means secured to said combustion chamber providing compressed air to said burner.

15. A hot water system according to claim 13 including:

a water distribution means positioned within said water tower adjacent said upper end and connected to said cold water inlet.

16. A hot water system according to claim 13 including:

a foranimous shelf positioned within said water tower above said combustion inlet opening; and packing positioned within said water tower on said shelf and extending upwardly to a height below said water distribution means, the packing permitting water to flow downwardly therethrough and products of combustion to flow simultaneously upwardly therethrough.

* * * * *